United States Patent [19]

Mitchell

[11] Patent Number: 5,016,542

[45] Date of Patent: May 21, 1991

[54] TRANSIT SYSTEM

[76] Inventor: Bruce Mitchell, 2078 North 1025 E., Terreton, Id. 83450

[21] Appl. No.: 451,593

[22] Filed: Dec. 18, 1989

[51] Int. Cl.[5] ..... E01B 26/00

[52] U.S. Cl. ..... 104/130; 104/140; 104/163; 104/303; 246/77

[58] Field of Search ..... 104/28, 88, 96, 130, 104/140, 145, 163, 295, 298, 303; 246/2 R, 2 F, 15, 77, 124

[56] References Cited

U.S. PATENT DOCUMENTS

| | | | |
|---|---|---|---|
| 1,672,364 | 6/1928 | Brown | 246/77 X |
| 1,821,039 | 9/1931 | Stoker | 246/77 |
| 2,902,945 | 9/1959 | Simon | 104/295 X |
| 3,587,470 | 6/1971 | Wilson | 104/130 X |
| 3,593,665 | 7/1971 | Marty | 104/88 |
| 3,628,462 | 12/1971 | Holt | 104/105 |
| 3,799,062 | 3/1974 | Stöcker | 104/96 X |
| 3,848,535 | 11/1974 | Mitchell | 104/88 |
| 4,048,923 | 9/1977 | Giraud | 104/165 X |
| 4,132,175 | 1/1979 | Miller et al. | 104/130 |
| 4,285,278 | 8/1981 | Mitchell | 104/96 |
| 4,503,778 | 3/1985 | Wilson | 104/28 |

*Primary Examiner*—Robert J. Oberleitner
*Assistant Examiner*—S. Joseph Morano
*Attorney, Agent, or Firm*—Robert A. de Groot; Stephen A. Gratton

[57] ABSTRACT

A closed loop transit system that transports passengers in vehicles to a destination of their choice where they exit a main line to a shunt line and station. The system has automatic means for bypassing vehicles past stations that are full and moving excess empty vehicles from one station to a next station that does not have excess vehicles.

13 Claims, 5 Drawing Sheets

TRANSIT SYSTEM

BACKGROUND OF THE INVENTION

This invention relates to an improved passenger vehicle transit rail system to be installed above a city sidewalk for carrying a plurality of passenger vehicles within a closed loop.

The ever increasing congestion on city streets, freeways, and other vehicular arteries, both inter-city and intra-city, has created a need for new ground transportation systems. It is well-known that the acceptance of a transmit system by the general public depends upon its ability to provide economical transportation which is as fast as or faster than other existing forms of transportation, such as the personal automobile, buses, streetcars, and the like. By way of example, a transit system, to be acceptable, must be capable of transporting as many people over any given route of the transit system as a typical freeway. Moreover, the transit system must be safer than the automobile and must be capable of reliable operation in all kinds of weather. Preferably, the passenger service of the transit system should be immune to stoppage as a result of labor disputes. Summarizing, then, the ideal transit system is one which satisfies five basic requirements; speed, economy, reliability, safety and continuous availability.

U.S. Pat. No. 3,493,664, issued July 20, 1971, discloses a conveying system that directs vehicles around a maze of tracks by a pair of slots in a flat surface below the vehicle, wherein the slots are engaged by rollers alternately engaging the slots to change vehicle direction, to either left or right.

U.S. Pat. No. 3,628,462, issued Dec. 23, 1971, discloses an overhead monorail vehicle switching apparatus that incorporates a pivotal mechanical rocking assembly that engages a left or right hand side of the overhead support rail, thereby selecting a left or right direction at a switch junction.

U.S. Pat. No. 3,848,535, issued Nov. 19, 1974, discloses an automatic overhead supporting monorail system. This system utilizes overhead mounted motors to propel the vehicle by driving a segmented tow bar supporting the vehicle from above.

U.S. Pat. No. 4,285,278, issued Aug. 25, 1981, discloses improvements to an overhead monorail transit system consisting of guide fingers slidably engaging guide bars causing the vehicle to turn into a station. Additionally, an improved turning means is disclosed consisting of a pair of wedge-shaped guides sliding within grooves in a flat platform located at each track turn below the car. The guides improve car stability by resisting centrifugal forces and turns.

SUMMARY OF THE INVENTION

The present invention provides a transit system which satisfies the foregoing requirements. In general terms, the transit system of the invention is characterized by a multiplicity of vehicles which are driven independently along a guide line complex. This guide line complex includes a main line and shunt lines with stations spaced at frequent intervals. Each station is located on a siding adjacent to a main line. Each siding has a length of shunt line for deceleration before reaching the station and a length of line for acceleration to main line speed. The passenger can direct the vehicle past all stations to any final destination by a manual control lever that directs the vehicle into a station by engaging guide slots under the vehicle on the main line deck between track rails. As the vehicle approaches the station of destination on the siding, the vehicle is automatically braked to bring the vehicle to a smooth stop in front of the station. The passenger then disembarks to empty the vehicle for the next passenger. After a new passenger enters, the vehicle is then propelled from the station of departure, accelerated to main line speed before entering the main line, and then propelled along the main guide line at a constant speed toward a new station of destination.

According to a feature of the invention, each vehicle includes an elongate tow bar which is pivoted at the front allowing back end movement between the guide beams of the transit system, and a cargo carrier mounted on wheels above the tow bar. In the preferred embodiment of the invention, this cargo carrier is a passenger vehicle or cab for holding two passengers.

The vehicle is propelled by motor-driven rollers mounted on support beams. These rollers are disposed for peripheral driving engagement with the longitudinal edges of the tow bar on each vehicle and are spaced such that they effect continuous driving of the vehicle as the latter moves along the guide line. Spacing between motors is slightly less than the length of the tow bar. The roller motors are started and brought up to speed immediately prior to engagement between the tow bar and the roller motors. Power to the motors is shut off after the tow bar passes through. All driving rollers on the main track run at the same speed so that all vehicles travel at the same speed. Acceleration and deceleration occurs only on the shunt lines.

The system of the present invention includes a conveyor belt in each station to slowly move vehicles that have entered the station. A counting means controls the number of vehicles within the station and a switching means is adapted to divert vehicles to a subsequent station from any station that is full. Additionally, a remote operator at a main control panel can divert any vehicle into a station in an emergency by overriding the controls in an individual vehicle.

In addition to application in a metropolitan environment as set forth above, the inventive system is well-suited for installation at large airports where passengers must travel between air terminals, or between air terminals and other ground transport systems.

DETAILED DESCRIPTION OF THE INVENTION

Figure 1:
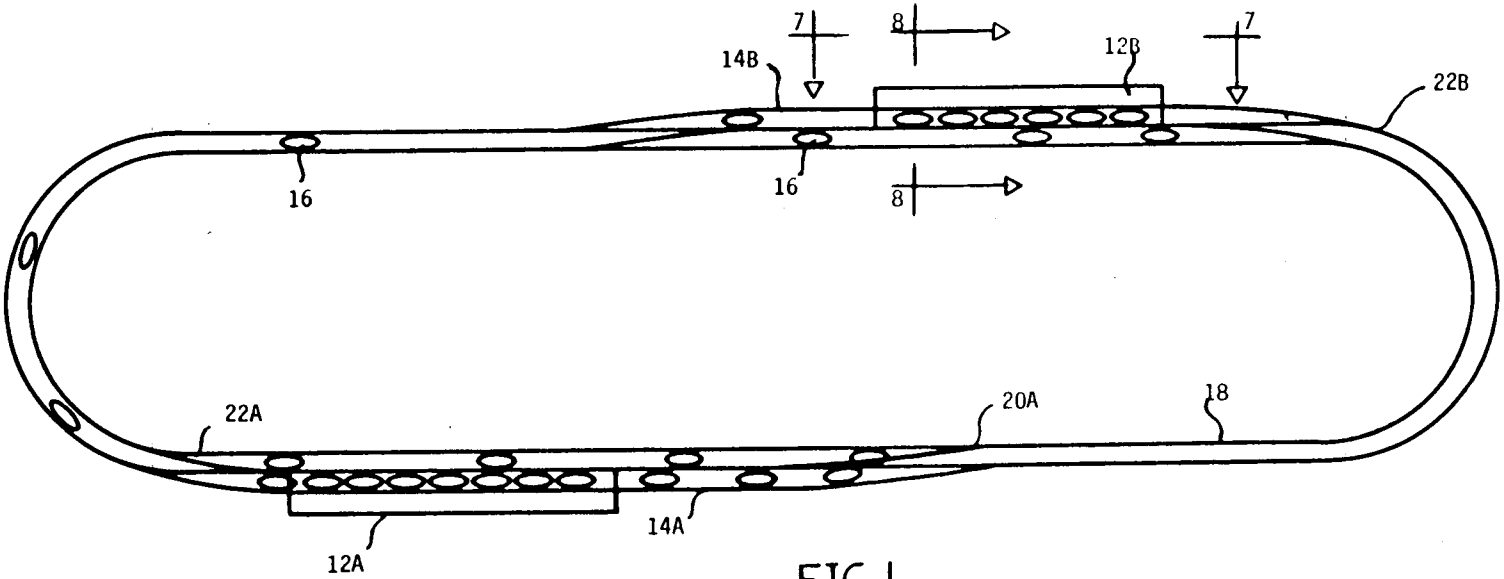
FIG. 1 is a schematic plan view of a simple two-station transport system of the present invention.

Referring to FIG. 1, the closed loop transit system 10, is illustrated with two stations 12*a* and 12*b* on the shunt tracks 14*a* and 14*b* and having a plurality of passenger vehicles 16 either in the stations, waiting on the shunt tracks, or travelling on the main line 18. It is to be understood that while the invention is described hereinafter with reference to vehicles adapted to transport people, such vehicles can be configured as cargo vehicles, as for instance in a large factory or facility with robotic delivery of parts or raw materials. Additionally, when adapted for carrying people, the 2-person design disclosed herein is not exclusive —the vehicles may be configured to transport any reasonable number of passengers. Each station has an entry portion 20*a* and 20*b* and an exit portion 22*a* and 22*b*. Each vehicle 16 is individually controlled by a passenger with reference to starting and selecting and entering a station, but the speed on the main track 18 is fixed by constant speed motors as set forth below.

Figure 4:
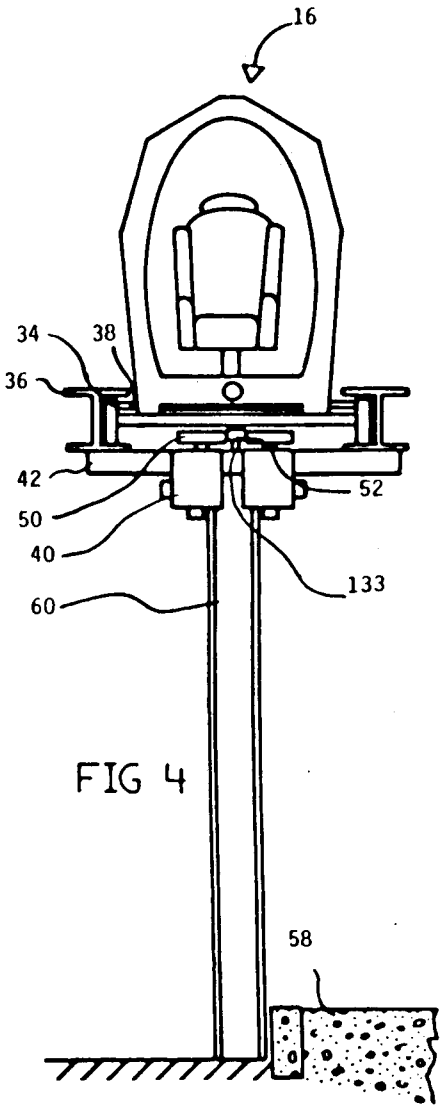
FIG. 4 is a front elevation of a vehicle and supporting structure of the present invention.
Figure 2:
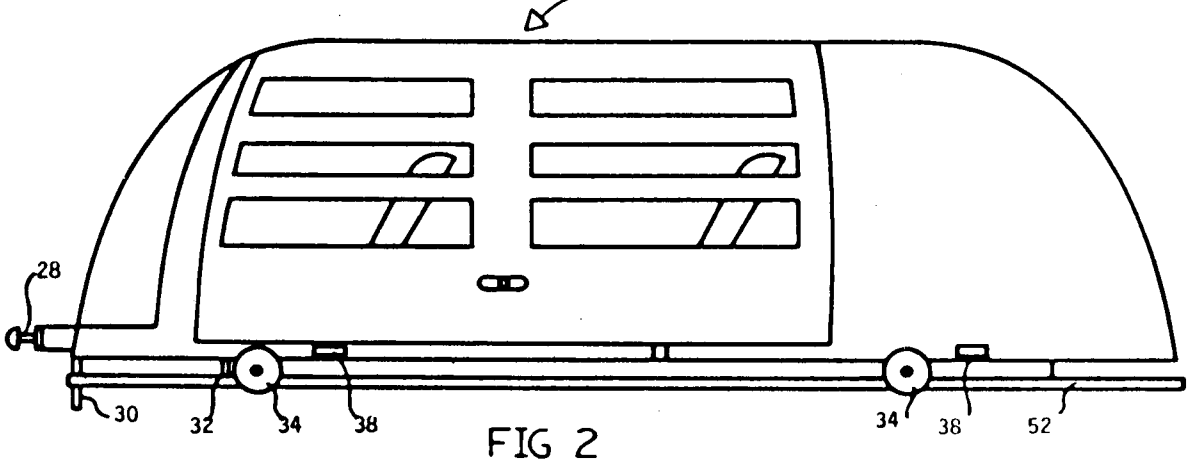
FIG. 2 is a side elevational view of a two-passenger vehicle of the present invention.
Figure 3:
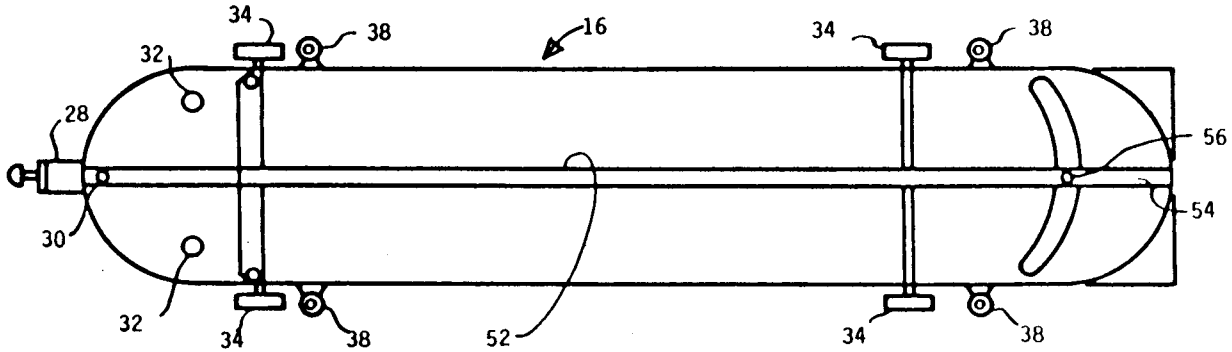
FIG. 3 is a bottom view of the two-passenger vehicle of FIG. 2.

Referring to FIGS. 2 and 3, in a primary embodiment, a light two-passenger vehicle 16, is illustrated. The vehicle is provided with a shock absorber 28, which is attached to the front of each vehicle to ameliorate the effects of contact in the station. Guidance of the vehicle 16 is effected by guide means in the form of a center pin 30 and a pair of side pins 32, which are actuated by the passenger through a mechanical linkage from within vehicle 16. Four wheels 34 support the vehicle between a pair of H-beams 36 (FIG. 4). The front wheels have a slight caster to avoid sliding while rounding curves. Four side wheels 38 prevent the vehicle from scraping against the sides of the H-beam 36.

Referring to FIG. 4, vehicle motion is imparted by one or more electric motors 40 suspended from support structure 42 below H-beam rails 36. The wheels 34 are captive within the upper and lower flanges of H-beam rails 36 except when the vehicle 16 is in the station entry 20 and the exit 22 (FIG. 1).

Each of the motors 40 are rigidly mounted below the H-beam rails and are provided with a drive wheel 50 that contacts either side of a tow bar 52, pivotally suspended below vehicle 16. The tow bar 52 pivots at pin 30, and a rearward portion 54 of tow bar 52 is supported vertically allowing lateral movement within an arcuate slide 56. The forward thrust of the drive motors is transmitted to the vehicle from the tow bar through a pivot bearing enclosing pin 30.

The vehicle 16, H-beams 36 and motors 40 are positioned above the ground surface such as a roadway, parking lot or the edge of sidewalk 58, etc., by a column 60 which can be placed at appropriate intervals.

It is contemplated that the vehicles utilized herein will be two-passenger vehicles having dimensions of approximately 12 feet (length)×3 feet (width)×4 feet (height). The H-beams 36 will therefore be positioned about three feet apart, with the motors 40 spaced at twelve-foot intervals to span the length of the 12-foot tow bar 52. Therefore, as the tow bar 52 engages one set of drive motors, it is disengaging the next-rearward pair of motors, so that there is a constant drive force on the tow bar 52 by the equally spaced motors 40. By pivoting, the rectangular tow bar 52 at 30, the vehicle 16 is permitted to make turns and still engage drive motors 40. Motors 40 can be activated by a pair of limit switches placed beneath the rails, and are actuated by contact with the tow bar 52. The first limit switch contact accelerates the motors 40 to operating speed (approximately 1750 rpm) and the second limit switch contact maintains the power to the motors throughout the twelve-foot travel of the tow bar 52 between the motors.

Figure 5:
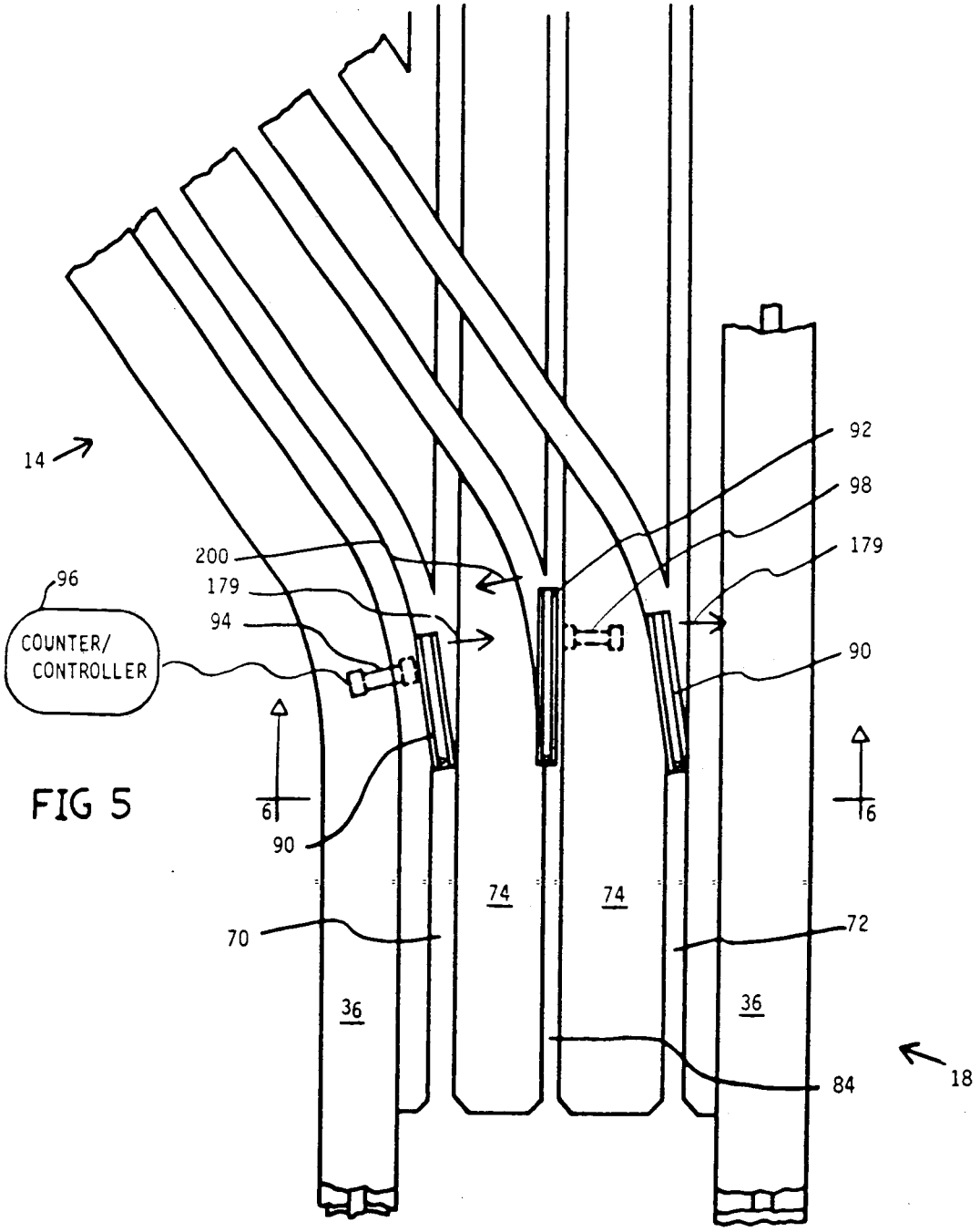
FIG. 5 is a schematic plan view of the rail switching apparatus of the present invention.
Figure 6:
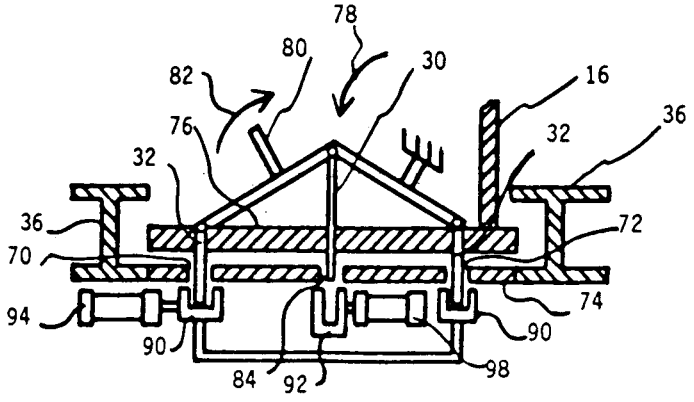
FIG. 6 is a sectional view taken along lines 6—6 of FIG. 5, with a schematic representation of the vehicle guide means added.

Referring to FIGS. 5 and 6, the directional switching system of the present invention causes the vehicle to enter the shunt track 14 at the station as illustrated in FIG. 1. The system comprises a pair of side guide slots 70, 72 and a center slot 84 in a deck portion 74 that is installed at each shunt track entry 20 and exit 22 portion (FIG. 1). The side guide slots 70, 72 engage the pins 32 (FIG. 6) that extend through the bottom 76 of vehicle 16. FIG. 6 illustrates the pins 32 slidably engaging the side slots 70, 72 with the center pin 30 disengaged from center slot 84. The pins 30, 32 may be actuated by any convenient means—as illustrated herein a mechanical linkage is utilized. However, it is to be appreciated that any one of a number of different methods may be utilized to actuate the pins, such as hydraulic, electric, pneumatic, etc. The specific features of which will be well-known to those skilled in the art. As illustrated in FIG. 6, the pins 32 have been actuated by the passenger to a down position by operation of steering linkage 78, and specifically by control lever 80 within vehicle 16. While still on the main line 18, the passenger moves the lever 80 to the position shown prior to entering the deck portion 74 at the particular station at which he wishes to exit. A passenger desiring to remain on the main line 18 has previously moved lever 80 in the direction of arrow 82 when starting the vehicle at the station. This action has extracted pins 32 from side slots 70, 72 and inserted center pin 30 into center slot 84, and vehicle 16 is guided straight ahead on the main line 18.

At the location of each entry portion 20 the side slots 70, 72 are provided with movable side guide vanes 90, and the center slot 84 is provided with a movable guide vane 92. Both of the side guide vanes 90 are operated together by an operating means, such as an hydraulic cylinder 94, when activated by a remote counter/controller 96. The side guide vanes 90 are illustrated in the normal "exit" position in FIG. 5, such that a vehicle will exit at a given station unless the steering linkage 78 is set with tee center pin 30 down. As illustrated in FIG. 5, the center guide vane 92 is normally set in the "no exit" position. By moving the lever 80 so that the side pins 32 are extended into slots 70, 72, the side pins 32 will enter the side vanes 90 and the vehicle will exit. The side vanes 90 may be interconnected, as by bar 97, so that a single operating means 94 will move the side vanes from the "exit" to the "no exit" position. As described below, the counter 96 will count the number of vehicles in a particular station and, when full, will actuate the operating means 94 to move the side vanes 90 from the normal "exit" position (illustrated in FIG. 5) to the "no exit" position. The vehicle will then proceed to the next station which is not full, and at which the side vanes 90 remain in the "exit" position.

Activation of the operating means 98 will cause the center vane 92 to move from the normal "no exit" position of FIG. 5 to an emergency "exit" position. Such movement will engage the center pin 30 of any vehicle with the center pin 30 in the down position. It is anticipated that the center guide vane 92 would be moved to the "exit" position only in an emergency situation wherein a master controller located at a remote location notes a condition that requires the vehicle to be directed into the nearest station. Such condition may be an emergency involving damaged vehicles or ailing passengers.

Figure 7:
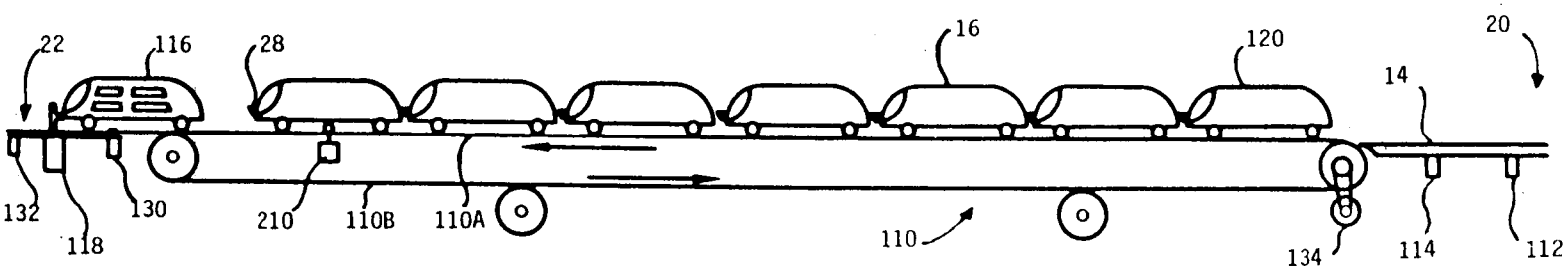
FIG. 7 is a schematic elevation view of the station and conveyor belt of the present invention.

FIG. 7 illustrates an enlarged view of the station 12, conveyor belt 110 and shunt track 14. The vehicles 16 switch off the main line at station entry 20 and are decelerated by means of slow speed motors 112, that engage the tow bar 52. The slower speed of motors 112 provide the braking action necessary to permit accumulation of vehicles 16 at station 12. Conveyor entry motor 114 operates at an even slower speed (for instance, at about one mile per hour as opposed to motors 112 at about 3 mph) to limit impact forces as the vehicle stops when the shock absorber 28 contacts the preceding vehicle. The conveyor 110 moves vehicles slowly from the station entrance shunt track 14 to a start position 116. The vehicle in start position 116 (the waiting position) is restrained from forward motion by solenoid-operated vehicle stop 118. The rear wheels of the vehicles in start position 116 remain on the conveyor belt 110*a* and rotate backwards with no ill effects while the vehicle is restrained by the vehicle stop 118.

Passengers board vehicles in the system when the vehicles are in position 116. Forward motion is begun, and the vehicle enters the system when the vehicle start motor 130 is energized, and the vehicle accelerates when acceleration motor 132 is activated by limit switches that are actuated as vehicle forward motion begins. The vehicle is accelerated to station exit 22 to enter the main line. The vehicle will not enter the main line if there is a vehicle approaching on the main line within about 70 feet of the station exit 22. Tow bar sensing limit switches 133 are provided at each motor 40 on the main line near station exits to de-energize a control circuit, (not shown) that limits entry of a vehicle onto the main line if a vehicle is close enough to the station exit 22 to result in either a collision or less than minimum separation between adjacent vehicles.

Figure 8:
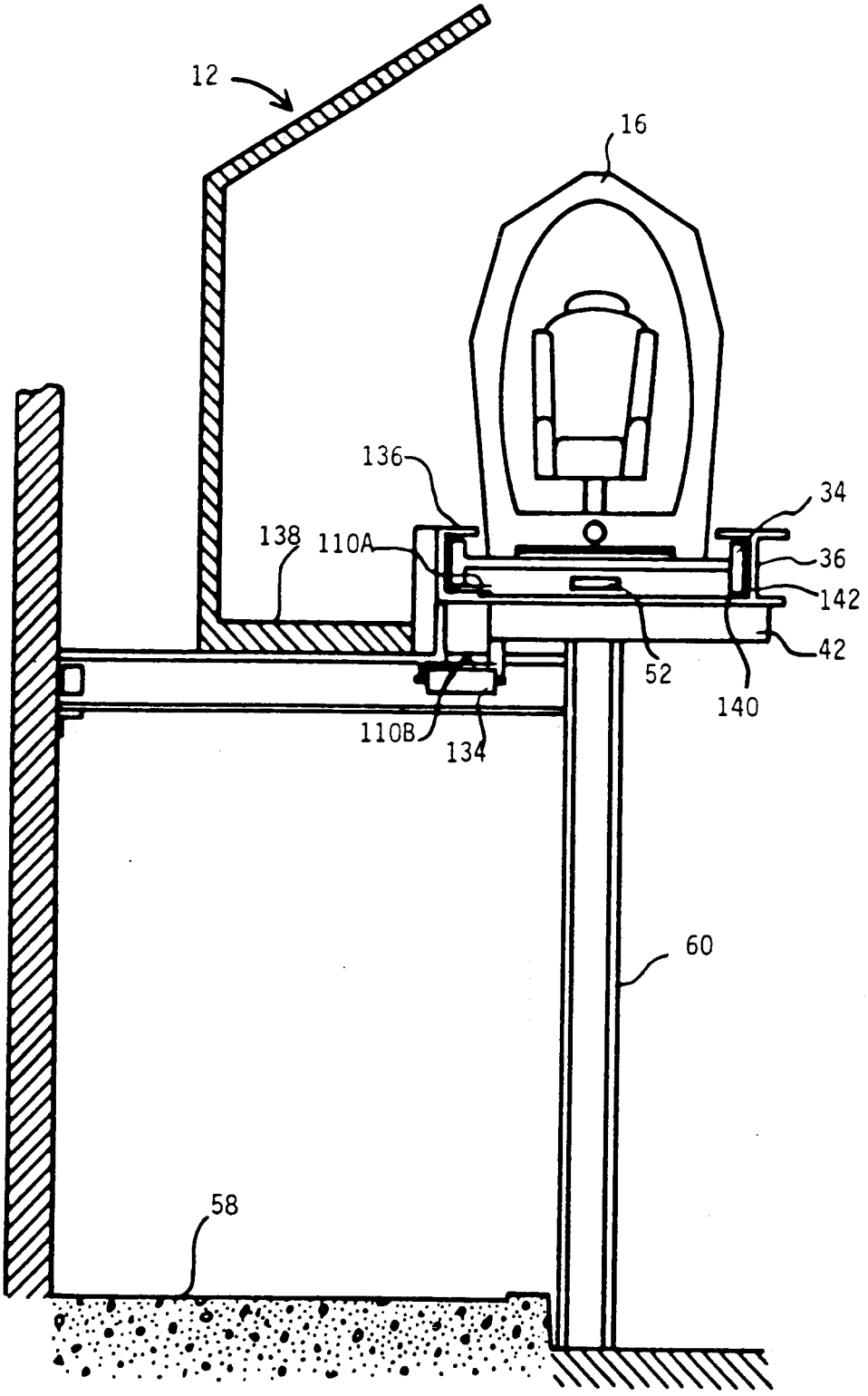
FIG. 8 is an elevation view of a vehicle sitting on the conveyor belt within the passenger station.

FIG. 8 illustrates a vehicle 16 in station 12, with the vehicle 16 engaging endless conveyor belt 110, which is in turn driven by conveyor motor 134. The upper portion 110*a* of conveyor belt 110 slides upon a lower leg of channel 136.

The station deck 138 is advantageously provided below the centerline of vehicle wheels 34. Space over sidewalk 58 is conserved by using the inner flange 140 of H-beam 36 for vehicles in the station and the outer flange 142 of beam 36 for vehicles on the main line. The conveyor belt 110 typically will transport and hold approximately seven vehicles as illustrated in FIG. 7, although the station may be configured to accommodate any number of vehicles. Access to the station deck 138 can be by stairs or elevator at the platform ends.

Figure 9:
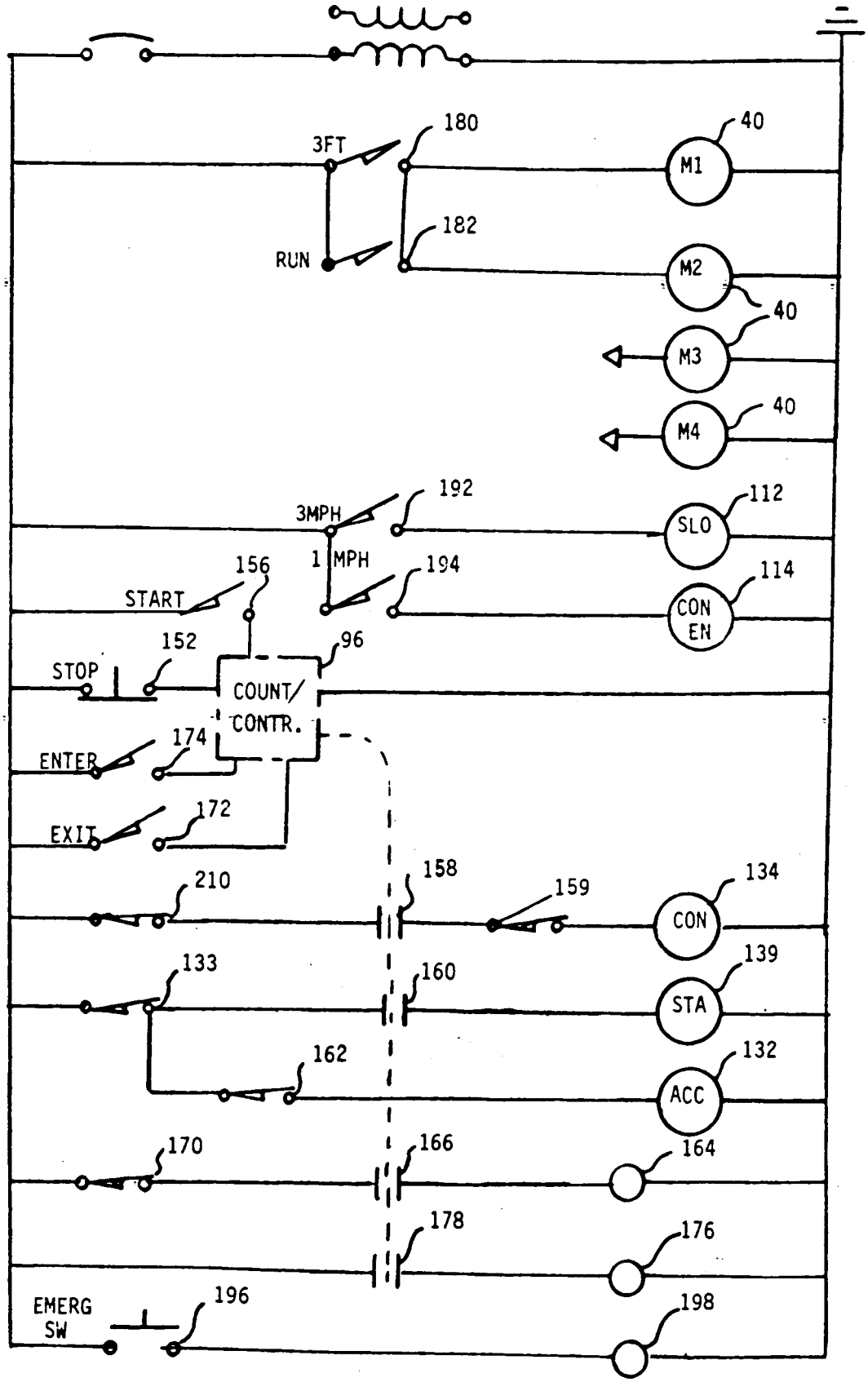
FIG. 9 is an electrical schematic of the system.

System operation will be described by reference to the station (FIG. 7) and the electrical schematic (FIG. 9). The operation of the system will be described based upon a situation wherein a full complement of vehicles 16 is available at a station, including a vehicle in start position 116. Eight vehicles (FIG. 7) is exemplary but not necessarily the fixed number.

A passenger pushes stop switch 152 at start position 116, thereby activating a timer (not shown) in counter/-controller 96. This prevents any vehicle motion until the passengers have entered and seated themselves within the vehicle at the start position 116 or other positions on the conveyor belt 110. Rotating the lever 80 to ensure that the center pin 30 is down and engaging the center guide vane 92 in the exit portion 22 activates a start switch 156 in the deck below the vehicle. Controller 96 is then activated to energize switch contacts 158 and 160 and thence the conveyor motor 134 and start motor 130. Accelerating motor 132 is started through limit switch contacts 162 that activate when vehicle motion commences. Contact 166 energizes the vehicle stop solenoid 164, lowering vehicle stop 118 (FIG. 7). If there is no approaching vehicle on the main line within, say, 70 feet of the station, the main line limit switches 133 will be closed and the vehicle 16 will be started and accelerated to the station exit 22 to enter the main line at approximately the main line speed. Upon exiting the station: the stop limit switch 170 opens, de-energizing stop solenoid 164, permitting a spring return to raise the stop 118 to halt the next oncoming vehicle which is being moved by the conveyor belt 110; the exiting vehicle actuates exit limit switch 172 reducing the vehicle count of counter/controller 96 to seven since there is now an empty position at conveyor position 120.

In a situation where the station conveyor is within one vehicle of being full and a passenger in a vehicle has caused the vehicle to enter at station entry 20, the vehicle activates enter limit switch 174 and the counter/-controller 96 energizes side vane solenoid 176 through contact 178. The solenoid 176 causes the side vanes 90 (FIG. 5) to move in the direction of arrow 179, preventing the next vehicle from exiting, and keeping it on the main line 18, even though the control lever 80 was set for station entry as illustrated in FIG. 6. The diverted vehicle will travel to and exit at the next available station that is not full. When the next vehicle with passengers leaves the station, counter/controller 96 then de-energizes side vane solenoid 176 to restore side vanes to the normal "exit" position (FIG. 5).

Each station has a variable vehicle occupancy quota that is set by a remote master controller, based on the particular activity at each station. The quota is determined by an "at rest" base quota condition where all vehicles are in the system stations, i.e., there are no cars on the main line 18. The quota for each station can be changed by the remote master controller who monitors passenger and vehicle availability at each station, to provide for the optimum distribution of vehicles. Normally there would be space for two extra vehicles above the base quota. For example, referring to FIG. 7, the base quota can be set at six vehicles, leaving room for two vehicles on conveyor 110. It is also possible to reduce the station quota to zero based on demand at other stations of the transit system.

When the station quota is reached, any vehicle entering the station activates counter/controller 96 to energize the start motor and conveyor motors 130 and 134 so that empty vehicles leave the station as described above, until the vehicle count is restored to the preset quota.

Vehicles leaving the station either empty or occupied are activated after an approximate three-five second delay by a timing circuit within the counter/controller 96 which controls activation of the start motor 130. Vehicle exit may be delayed by the approach of a vehicle on the main line, if such vehicle is within the minimum separation distance between vehicles.

In normal operation, the vehicles are maintained at relatively constant speed by motors 40 which are started three feet before the vehicle tow bars contact the motors 40 by actuation of 3-foot limit switch 180. As the tow bar contacts the motor drive wheels 50 (FIG. 4) the second run limit switch 182 is actuated, thereby powering the motors for an additional twelve feet of vehicle and tow bar travel.

Vehicles entering the station actuate enter limit switch 174 which in turn starts conveyor motor 130. Vehicles are then decelerated by slow motors 112 that are also energized when the vehicle enters the shunt line and activates the three mph limit switch 192 and the one mph limit switch 194, which in turn activates the conveyor entry motor 114. As each car enters the station they are moved towards exit 22 by conveyor belt 110*a* motion. The conveyor motor is deactivated when a limit switch 210 is actuated and the car count in the station, as counted by the counter/controller 96, is one greater than the car position on the conveyor. While only one limit switch is shown in the figures, it is to be understood that there are actually seven switches, or one for each vehicle position on the conveyor belt.

In an emergency requiring the shunting of a vehicle from the main line into a station, emergency switch 196 is actuated for the appropriate station by the master controller, which thereby energizes center vane solenoid 198 causing center vane 92 (FIG. 5) to move in the direction of arrow 200. Therefore, any vehicle with the control lever set for main line travel, i.e., center pin 30 down (FIG. 6) will be diverted into the station. The master controller can monitor the entire system by means of T.V. monitors.

The description above of the various features disclosed in FIG. 9 are to be considered exemplary only; there are many different methods of effecting the exit and reentry of vehicles in this system. Therefore, while the invention has been described with some specificity, it is believed that alternatives would be apparent to one of ordinary skill in the art after review of this disclosure.

While a preferred embodiment of the invention has been disclosed, various modes of carrying out the principles disclosed herein are contemplated as being within the scope of the following claims. Therefore, it is understood that the scope of the invention is not to be limited except as otherwise set forth in the claims.

I claim:

1. An improved closed loop passenger vehicle transit system comprising:

a. an overhead main line track suspended above a ground surface;

b. a plurality of passenger loading and unloading stations adjacent the main line having a station entry portion and a station exit portion;

c. a metal deck at each station entry portion and each station exit portion having a pair of side guide slots and a center slot;

d. a pair of hydraulically movable side guide vanes cooperating with the side guide slots at each station entry portion and having a normally "exit" position;

e. a hydraulically movable center guide vane cooperating with the center slot at each station entry portion and having a normally "no exit" position;

f. a plurality of passenger vehicles having wheels supported on the main line;

g. a tow bar pivotally mounted under each vehicle;

h. a plurality of motors mounted under the main line having drive wheels in rotational engagement with longitudinal edges of the tow bar;

i. a movable manual control lever within the vehicles having a center pin and a pair of side pins to engage said center slot and side guide slots; wherein when the passenger desires to exit from the main line, the control lever is moved to engage the side pins in the side guide so as to exit the main line unless the hydraulically movable side guide vanes have been moved to a "no exit" position by controller system means, and when the passenger desires to proceed past a station entry portion, the control lever is moved to engage the center pin in the center slot and center guide vane so as to proceed past the station entry portion unless the hydraulically movable center guide vane has been moved to an "exit" position by a remote master controller;

j. means to exit and accelerate a start position vehicle from the station;

k. means to decelerate the vehicles at the station entry portion;

means to advance the vehicles within the station; and m. said controller system means to count and control vehicle starting, station entry, and station exit operation.

2. The transit system recited as claim 1, wherein a motor-driven conveyor belt within each station conveys vehicles from the station entry portion to a start position.

3. The transit system as recited in claim 1, wherein the main line track comprises a pair of H-beams with the vehicle wheels travelling within an upper and lower flange of the H-beams.

4. The transit system as recited in claim 1, wherein the center guide vane is actuated by said remote master controller to divert a vehicle into the station in an emergency.

5. The transit system as recited in claim 1, wherein the plurality of motors are mounted, at intervals equal to the length of the tow bar.

6. The transit system as recited in claim 1, wherein the side pins and center pin are pivotally mounted on a lever arm such that if the side pins are down, the center pin is up, making engagement with center or side slots mutually exclusive.

7. The transit system as recited in claim 2, wherein the controller system means to control movement of vehicles comprises:

a. a counter/controller; and b. a plurality of limit switches affixed under the main line station, entry portion and station exit portion such that the switches are activated by the vehicle two bar as said vehicle moves along the track and activation of the switches energizes a vehicle counting circuit within the counter/controller thereby controlling vehicle entry or exit from the station.

8. The transit system as recited in claim 7, wherein means to exit and accelerate the start position vehicle from the station exit portion comprises:

a. a start motor in rotational engagement with the tow bar as a vehicle exits the station;

b. an accelerator motor in engagement with the tow bar as a vehicle exits the station;

c. an electrical stop solenoid mounted below the vehicle;

d. a mechanical stop operated by the stop solenoid restraining vehicle motion until the solenoid is energized; and e. an accelerator motor limit switch electrically connecting a power source to the accelerator motor, wherein the vehicle is accelerated first by the start motor and second by the accelerator motor after energization of the stop solenoid.

9. The transit system as recited in claim 7, wherein means to decelerate the vehicle at the station entry portion comprises:

a. a slow-speed motor in rotational engagement with the tow bar as the vehicle enters the station;

b. a conveyor entry motor in rotational engagement with the tow bar as the vehicle enters the station;

c. a three-mile-per-hour limit switch mounted below the station entry track; and d. a one-mile-per-hour limit switch mounted below the station entry track adjacent the conveyor belt, wherein the slow speed motor is energized by the vehicle contacting the three-mile-per-hour limit switch, followed by energization of the conveyor entry motor by the vehicle contacting the one-mile-per-hour limit switch.

10. The transit system as recited in claim 7, wherein means to advance a vehicle within the station from entry portion to exit portion comprises:

a. a conveyor motor;

b. a conveyor belt driven by the conveyor motor supporting the vehicle wheels, thereby moving the vehicle towards the exit portion when activated by the conveyor motor.

11. The transit system as recited in claim 8, wherein means to count an excess vehicle comprises:

a. a vehicle enter limit switch that when activated by a tow bar adds a count of one within the counter/-controller;

b. a vehicle exit limit switch that when activated by a tow bar subtracts a count of one within the counter/controller; and c. a counter/controller contact is series with and controlling power to the start motor; and such that when the number of vehicles at one station exceeds a prescribed number in the counter/controller, an empty vehicle is caused to exit the start position by energizing the start motor via said counter/controller series contact.

12. The transit system as recited in claim 8, wherein a vehicle is prevented from starting from a station if there is a vehicle on the main line approaching the station exit, by means of limit switches on the main line that interrupt electric power to the start motor and acceleration motor.

13. The transit system as recited in claim 11, wherein a full station vehicle reduction means to reduce excess vehicles comprises a side vane solenoid actuated by the counter/controller, thereby actuating the side guide vanes to a "no exit" position and thus preventing vehicle exit from the main line track.

* * * * *